US007607853B2

(12) United States Patent
Busam et al.

(10) Patent No.: US 7,607,853 B2
(45) Date of Patent: Oct. 27, 2009

(54) SLIDABLE BINDING MECHANISM

(75) Inventors: Edward P. Busam, Mason, OH (US); J. Michael Tims, Kettering, OH (US); Lewis Ray Dyson, Milford, OH (US); Stephen D. Wehmeyer, Cincinnati, OH (US)

(73) Assignee: MeadWestvaco Corporation, Glen Allen, VA (US)

( * ) Notice: Subject to any disclaimer, the term of this patent is extended or adjusted under 35 U.S.C. 154(b) by 592 days.

(21) Appl. No.: 10/941,343

(22) Filed: Sep. 15, 2004

(65) Prior Publication Data

US 2006/0056907 A1 Mar. 16, 2006

(51) Int. Cl.
*B42F 13/30* (2006.01)

(52) U.S. Cl. ..... 402/46; 402/56; 402/19

(58) Field of Classification Search ..... 402/19–20, 402/26, 31, 37–39, 46, 55–56, 41, 70, 73, 402/502, 3; D19/26–27
See application file for complete search history.

(56) References Cited

U.S. PATENT DOCUMENTS

| | | | | | |
|---|---|---|---|---|---|
| 1,758,327 | A | * | 5/1930 | Lotter | 402/56 |
| 1,960,280 | A | * | 5/1934 | Ritzinger | 402/46 |
| 2,211,546 | A | * | 8/1940 | Rabinof | 402/56 |
| 2,212,380 | A | * | 8/1940 | Steele | 402/56 |
| 2,251,878 | A | * | 8/1941 | Hanna et al. | 402/26 |
| 2,440,945 | A | * | 5/1948 | Hanna | 402/56 |
| 2,543,866 | A | * | 3/1951 | Panfil, Sr. | 402/26 |
| 2,644,456 | A | | 7/1953 | Marsh | |
| 2,664,897 | A | | 1/1954 | Derringer | |
| 3,077,888 | A | | 2/1963 | Thieme | |
| 3,205,895 | A | * | 9/1965 | Johnson | 402/38 |
| 3,833,308 | A | * | 9/1974 | Seaborn | 402/56 |
| 4,486,112 | A | * | 12/1984 | Cummins | 402/34 |
| 4,571,108 | A | * | 2/1986 | Vogl | 402/38 |
| 5,018,896 | A | | 5/1991 | Vanni | |
| 5,667,324 | A | | 9/1997 | Aoki | |
| 5,713,551 | A | * | 2/1998 | Doerner | 248/441.1 |
| 5,827,004 | A | | 10/1998 | Kim | |
| 2005/0265775 | A1 | * | 12/2005 | Morgan et al. | 402/38 |

FOREIGN PATENT DOCUMENTS

GB 2230231 A * 10/1990

OTHER PUBLICATIONS

Color photographs (6 pages) of Trapper Keeper® notebook binder sold by The Mead Corporation (1995).

* cited by examiner

*Primary Examiner*—Dana Ross
*Assistant Examiner*—Jamila Williams
(74) *Attorney, Agent, or Firm*—Alison R. Scheidler; Donald G. Bauer

(57) ABSTRACT

A binding mechanism system including a first support portion including a first ring portion located thereon and a second support portion including a second ring portion located thereon. At least one of the first and second support portions is movable relative to the other between a closed position wherein the first and second ring portions contact to form a generally closed ring, and an open position wherein the first and second ring portions are spaced apart from each other. The binding mechanism further includes an indicator that is generally visible when the ring portions are in one of the open or closed position and that is generally not visible when the ring portions are in the other one of the open or closed positions.

25 Claims, 7 Drawing Sheets

SLIDABLE BINDING MECHANISM

The present invention is directed to a binding mechanism, and more particularly, to a binding mechanism having support portions which are slidable or movable relative to each other.

BACKGROUND

Binding mechanisms are widely used in binders, notebooks, folders and the like to bind loose leaf papers and other components together. Three-ring binding mechanisms typically include a set of three rings which are selectively openable and closable to allow papers to be easily inserted into, and removed from, the binding mechanism. However, existing three-ring binding mechanisms may be difficult to operate, expensive to manufacture and may lack robustness. Furthermore, many existing ring binding mechanisms do not provide positive feedback regarding the open and/or closed nature of the binding mechanism. Finally, many existing ring binding mechanism are spring loaded which can be difficult to operate and can pinch a user's fingers when closed. Accordingly, there is a need for a robust binding mechanism that is easy to operate, easy to manufacture, and provides positive positional feedback.

SUMMARY

In one embodiment, the present invention is a binding mechanism which is easy to operate and manufacture, and is relatively strong and robust, and provides positive positional feedback. In particular, in one embodiment, the invention is a binding mechanism system including a first support portion including a first ring portion located thereon and a second support portion including a second ring portion located thereon. At least one of said first and second support portions is movable relative to the other between a closed position wherein the first and second ring portions contact to form a generally closed ring, and an open position wherein the first and second ring portions are spaced apart from each other. The binding mechanism further includes an indicator that is generally visible when the ring portions are in one of the open or closed position and that is generally not visible when the ring portions are in the other one of the open or closed positions.

In another embodiment the invention is a binding mechanism including a first support portion including a plurality of first ring portions located thereon and a plurality of guide structures located thereon. The binding mechanism further includes a second support portion including plurality of second ring portions located thereon. At least one of said first and second support portions is movable relative to the other between a closed position wherein respective ones of the first and second ring portions contact to form a plurality of generally closed rings, and an open position wherein the respective first and second ring portions are spaced apart from each other. The binding mechanism further includes an actuator including a plurality of actuator structures located thereon. The actuator structures cooperate with the guide structures such that movement of the actuator causes relative movement between the first and second support portions. The guide structure and actuator structures are arranged such that at least two of the actuator structures or guide structures are located adjacent to an associated one of the ring portions when the first and second support portions are in the closed position.

In yet another embodiment, the invention is a binding mechanism including a first support portion including a first ring portion located thereon and a second support portion including a second ring portion located thereon. At least one of said first and second support portions is movable relative to the other between a closed position wherein the first and second ring portions contact to form a generally closed ring, and an open position wherein the first and second ring portions are spaced apart from each other. The binding mechanism further includes an actuator which can be manually operated to move the first and second support portions between the open and closed positions, and a locking mechanism which is operable to fixedly secure the first support portion and the actuator together when the first and second support portions are in the closed position.

Other objects and advantages of the present invention will be apparent from the following description and the accompanying drawings.

DETAILED DESCRIPTION

Figure 1:
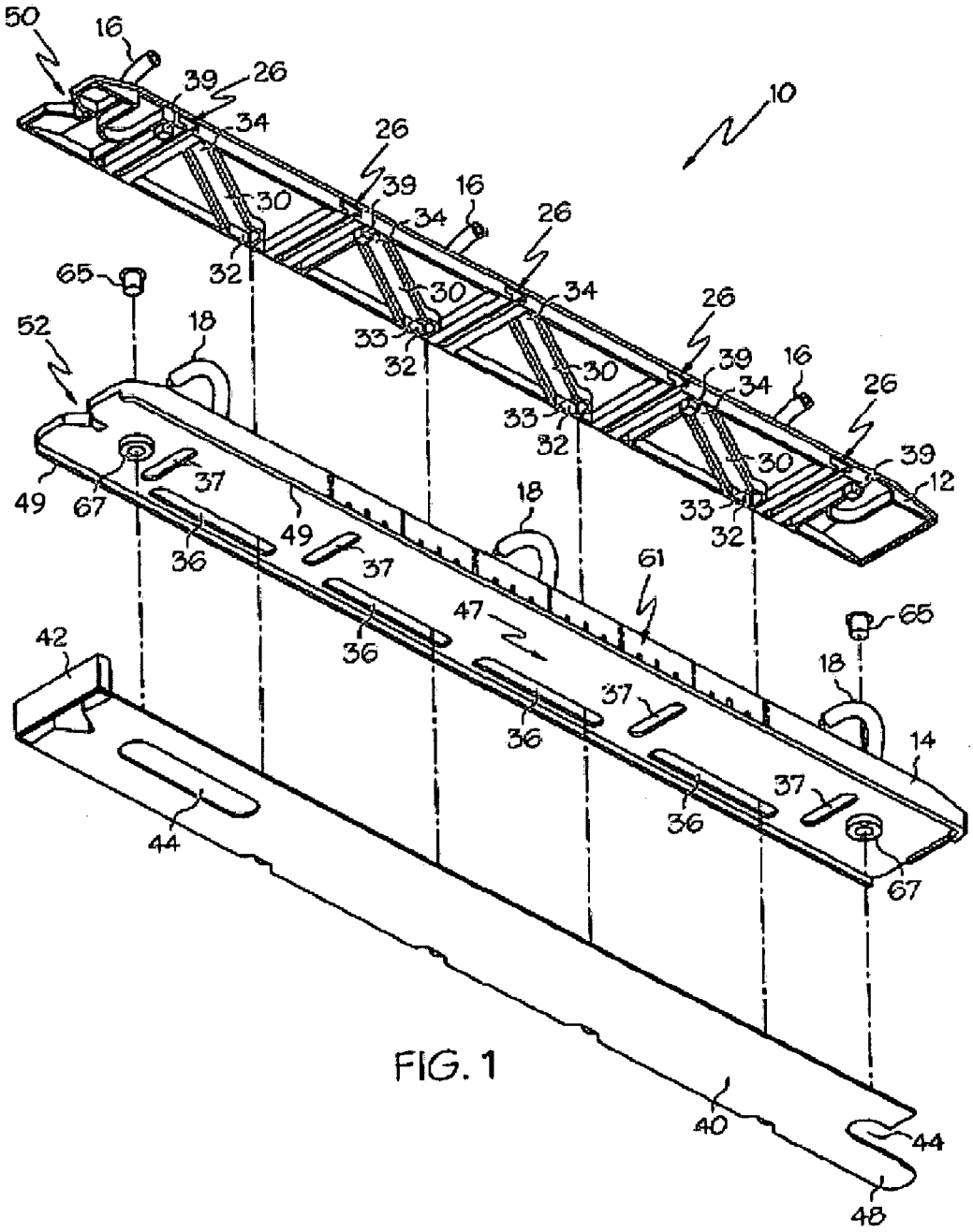
FIG. 1 is a bottom perspective exploded view of one embodiment of the binding mechanism of the present invention.

The binding mechanism of the present invention, generally designated 10, includes an upper or first generally rectangular support portion 12 and a second or lower generally rectangular support portion 14 slidably coupled to the upper support portion 12. The upper support portion 12 has a set of first ring portions or ring halves 16 located thereon, and the lower support portion 14 has a plurality of second ring portions or ring halves 18 located thereon. When the binding mechanism 10 is in its closed position (FIGS. 5 and 6), each of the first ring portions 16 contacts an associated second ring portion 18 to form a generally closed ring. The binding mechanism 10 is also movable to an open position (FIGS. 3 and 4) wherein the first and second ring portions 16, 18 are spaced apart from each other. In the illustrated embodiment, the binding mechanism includes three equally-spaced rings 20, 22, 24, although the number, shape and arrangement of the rings may be varied as desired to accommodate the hole spacing of the papers 13 or other components to be bound thereto.

Figure 2:
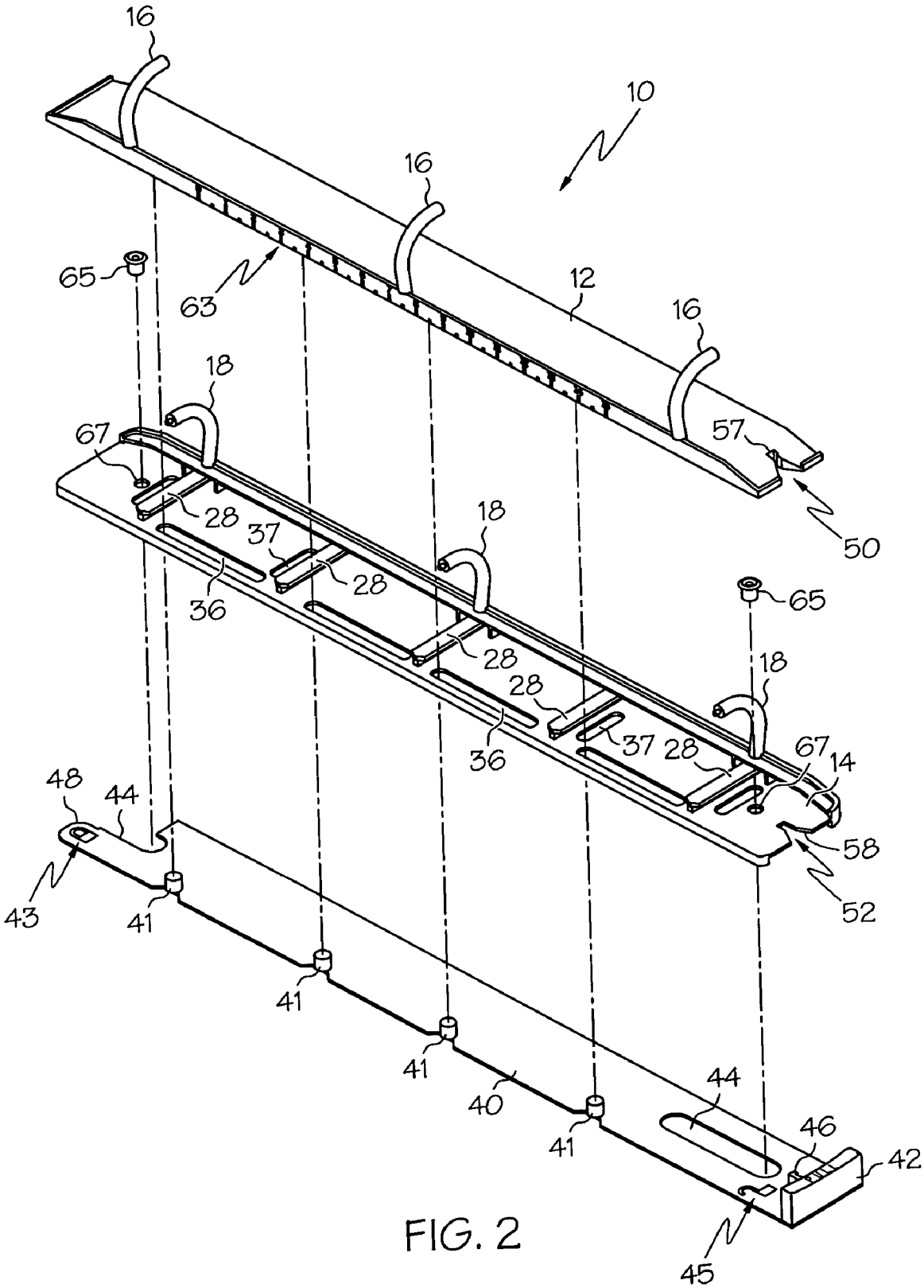
FIG. 2 is a top perspective exploded view of the binding mechanism of FIG. 1.

As best shown in FIG. 1, the upper support portion 12 has a set of generally "T"-shaped slide channels 26 extending across its width thereof. As shown in FIG. 2, the lower support portion 14 includes a plurality of generally "T"-shaped slide protrusions 28 shaped to slidably fit into a corresponding slide channel 26. In this manner, when the upper 12 and lower 14 support portions are coupled together, the slide channels 26 and slide protrusions 28 cooperate to guide that lateral sliding motion between the upper 12 and lower 14 support portions.

In the illustrated embodiment, a slide channel 26/slide protrusion 28 is located adjacent to each of the ring portions 16, 18 to ensure proper alignment of the ring portions 16, 18 when the binding mechanism 10 is in its closed position. Slide channels 26/slide protrusions 28 may also be located between each of the ring portions 16, 18 to provide additional sliding guidance. Although the slide channels 26 and slide protrusions 28 are illustrated as being generally "T"-shaped in end view, the slide channels 26 and slide protrusions 28 may take any of a variety of shapes, preferably complementary shapes, to guide the sliding of the support portions 12, 14. Furthermore, any of a wide variety of structures may be used to slidably couple the upper 12 and lower 14 support portions.

As best shown in FIG. 1, the upper support portion 12 includes a plurality of angled guide slots 30 located on a lower surface thereof. Each guide slot 30 extends generally at an angle and includes a home portion 32 and a stop portion 34 located at either end. The lower support portion 14 includes a plurality of access slots 36 formed therethrough. The binding mechanism 10 further includes a generally flat, planar actuator 40 having a plurality of actuator protrusions 41 located on an upper surface thereof (FIG. 2). In the illustrated embodiment, each actuator protrusion 41 is generally cylindrical in shape, although the actuator protrusions 41 can have any of a wide variety of shapes and sizes.

When the binder mechanism 10 is fully assembled, each actuator protrusion 41 is received through one of the access slots 36 of the lower support portion 14 and slidably received in one of the angled guide slots 30 of the upper support portion 12. Each cylindrical protrusion 41 may have a generally flat top surface to guide sliding motion of the upper support portion 12 thereon, and may have curved surfaces along its base to provide for secure attachment to the actuator 40.

Figure 7:
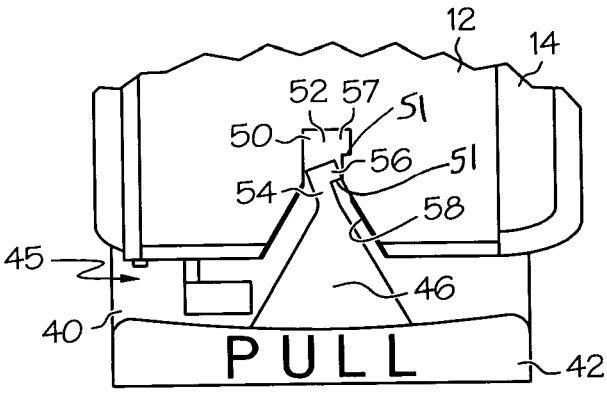
FIG. 7 is a detail view of the area indicated in FIG. 6, with the actuator slightly open.
Figure 8:
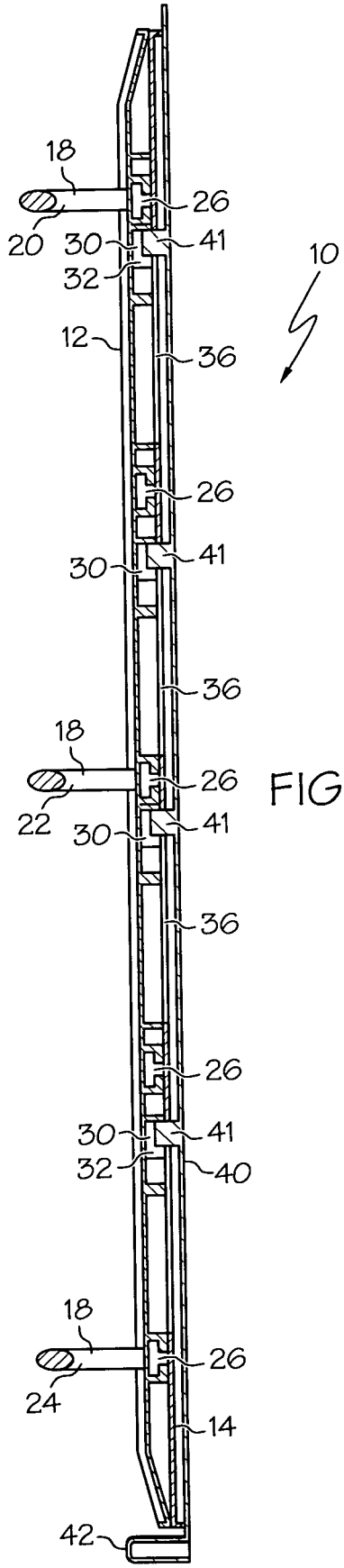
FIG. 8 is a side cross section taken along line 8-8 of FIG. 6.

The actuator 40 includes a gripping portion 42 extending generally perpendicular to the main flat surface of the actuator 40. As shown in FIG. 7, the gripping portion may be slightly curved or concave in top view to receive the finger of an operator thereon. As shown in FIGS. 1 and 2, the actuator 40 further includes a pair of fastener slots 44 formed therein, and includes a locking protrusion 46 extending inwardly from the gripping portion 42. The actuator 40 further includes an indicator portion 48 located adjacent to the upper fastener slot 44.

The actuator 40 may have a width generally corresponding to the width of the upper 12 and lower 14 support portions. In particular, in one embodiment, the actuator 40 has a width of at least about 75% of the width of at least one of the upper 12 or lower 14 support portions. The relatively wide shape of the actuator 40 helps to provide stiffness and stability to the binding mechanism 10. In addition, the lower support portion 14 may include a pair of side ridges 49 defining an actuator slot 47 therebetween (see FIG. 1). The actuator 40 is preferably sized and shaped to closely fit between the ridges 49 and in the slot 47 so that sliding motion of the actuator 40 is guided by the ridges 49 and slot 47.

Figure 6:
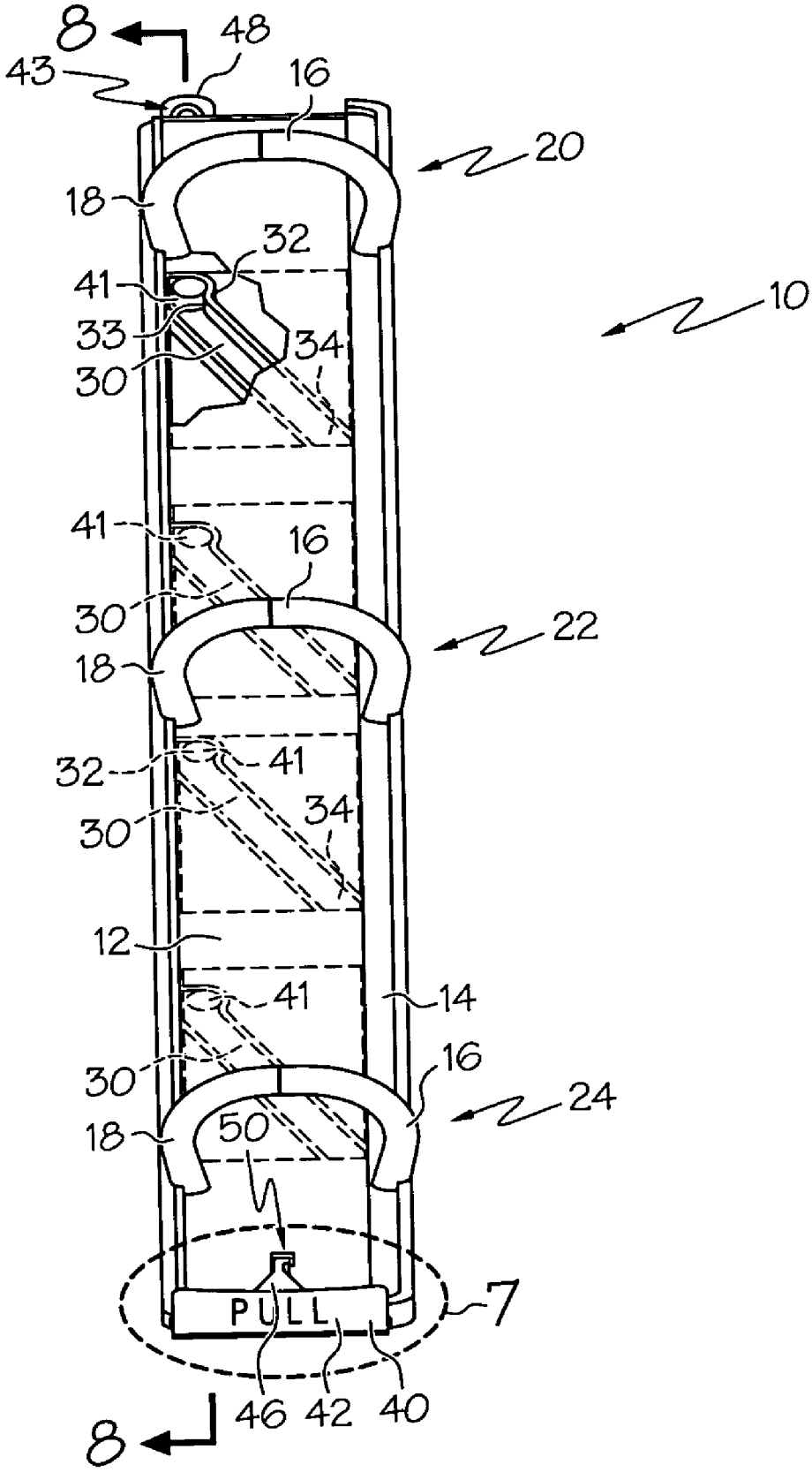
FIG. 6 is a top perspective view of the binding mechanism of FIG. 5, showing portions of the actuator system in hidden lines and with part of the binding mechanism cut away.

When the binding mechanism 10 is assembled, each slide protrusion 28 is received in a slide channel 26 to slidably couple the upper 12 and lower 14 portions. Each protrusion 41 of the actuator 40 is received through an access slot 36 of the lower portion 14 and received in a guide slot 30 of the upper portion 12. As best shown in FIG. 6, when the binding mechanism 10 is assembled and is in its closed position, each actuator protrusion 41 is located at the home position 32 of an associated guide slot 30. In order to open the binding mechanism 10, a user may grip the gripping portion 42 of the actuator 40 and pull the actuator 40 downwardly. This downward (or outward) movement of the actuator 40 slides each actuator protrusion 41 along its associated guide slot 30 such that each actuator protrusion 41 acts as a cam to force the upper support portion 12 to the left of its position shown in FIG. 6.

Once the actuator 40 is fully retracted, each actuator protrusion 41 may be located in the stop position 34 of the associated guide slot 30 and the binding mechanism 10 is in its fully open position (FIG. 4) and the ring portions 16, 18 are spaced apart. In order to return the binding mechanism 10 to its closed position, the actuator 40 is pushed inwardly (or upwardly from its position shown in FIG. 4) until each actuator protrusion 41 is returned to its home position 32, as shown in FIG. 6.

Figure 4:
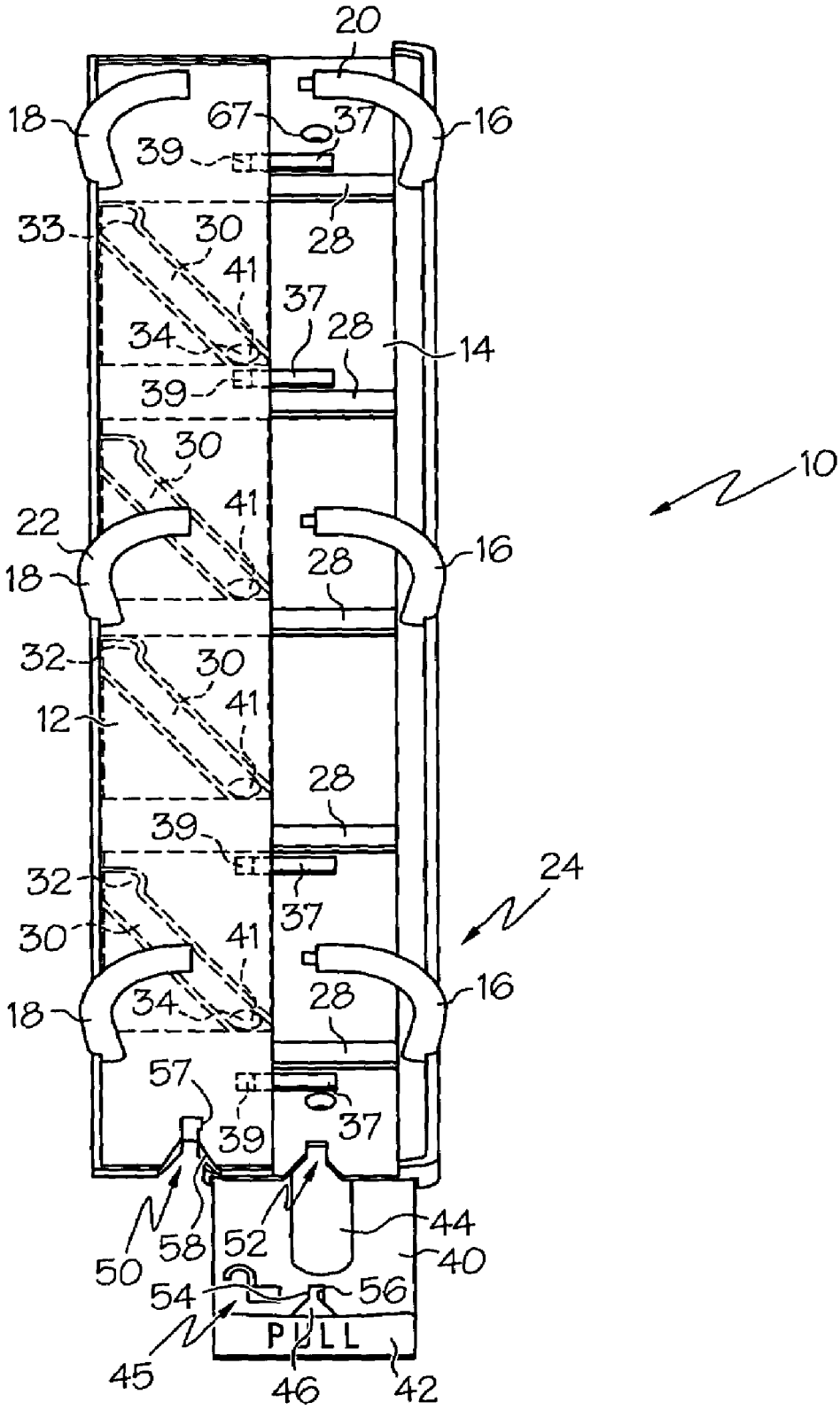
FIG. 4 is a top perspective view of the binding mechanism of FIG. 3, showing portions of the actuator system in hidden lines.
Figure 5:
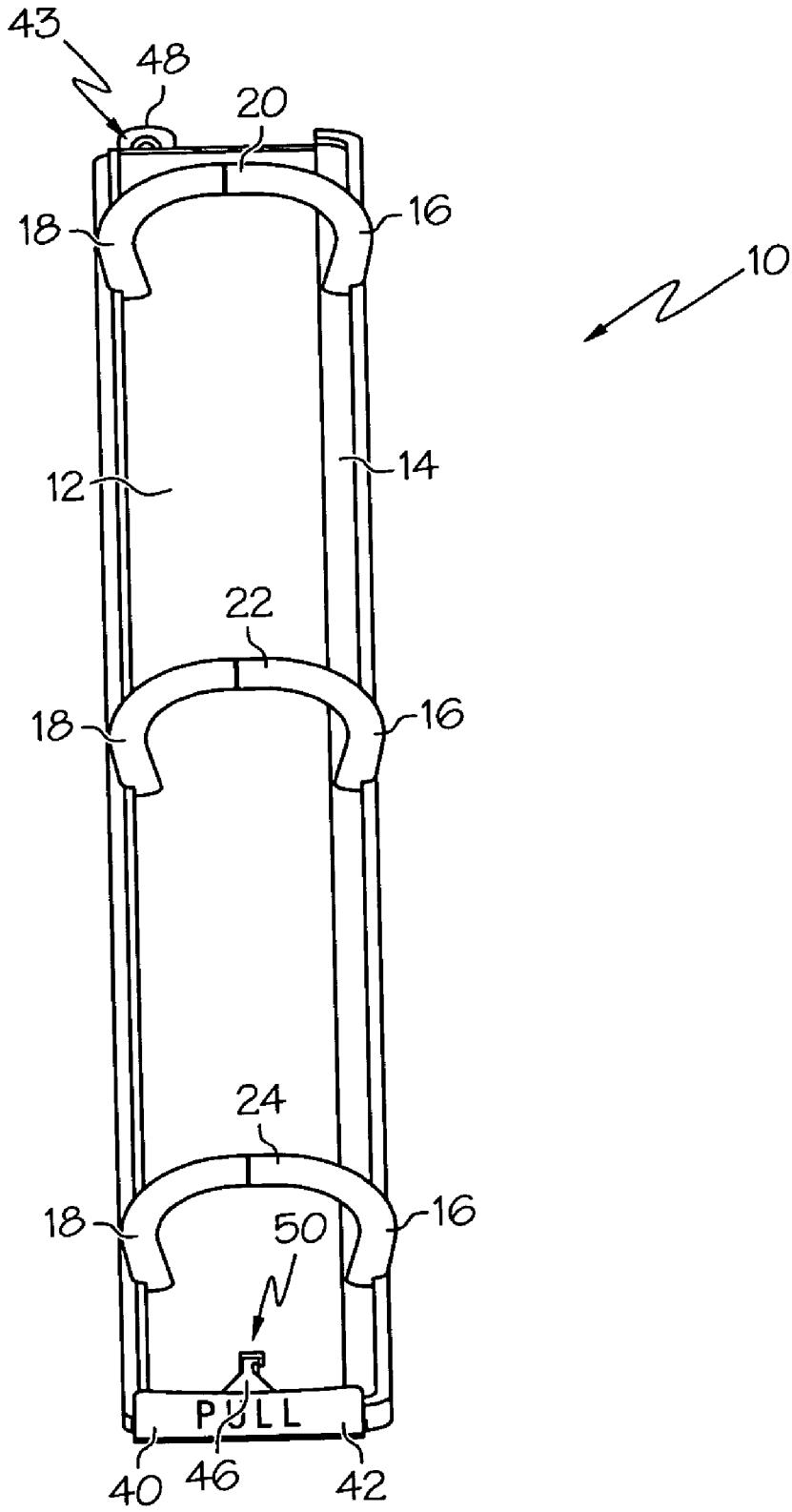
FIG. 5 is a top perspective view of the binding mechanism of FIG. 4, shown in its closed position.

As can be seen in FIGS. 1, 4 and 6, the home position 32 of one or more of the actuator guide slots may include a slightly inwardly-extending "dimple" 33 which forms a "corner" or area of narrowing along the guide slot 30 which may be slightly narrower than an actuator protrusion 41. Thus, a slightly increased force may be required to press each actuator protrusion 41 into its home position 32, or pull each actuator protrusion 41 from its home position 32. This movement of the actuator 40 into or out of the closed position creates a "snap" feel as the binding mechanism 10 is moved into or out of its closed position.

Although the illustrated embodiment shows the actuator protrusions 41 being located on the actuator 40 and the guide slots 30 being located on the upper support portion 12, this configuration may be reversed such that the protrusions are located on the upper support portion 12 and the guide slots are located on the actuator 40. Furthermore, various other structures besides the protrusions/slots (such as cams, levers, spring-loaded components, various mechanical structures, etc.) may be utilized to cause the opening and closing of the binding mechanism 10.

The position of the actuator slots 30 and actuator protrusions 41 is selected to provide stability of the binding mechanism 10. In particular, as shown in FIG. 6, when the binding mechanism 10 is in its closed position, an actuator protrusion 41 is located adjacent or immediately adjacent to each of the two upper rings 20, 22 to help prevent any inadvertent opening of the two upper rings 20, 22. In other words, the ring portions 16, 18 and upper 12 and lower 14 support portions are firmly attached together at the upper two rings 20, 22. In contrast, when the binding mechanism 10 is in its open position (FIG. 4), an actuator protrusion 41 is adjacent or located immediately adjacent to the two lower rings 22, 24 to ensure that the support portions 12, 14 are stably held together at the lower two rings 22, 24.

In particular, the protrusions 41 may be located adjacent to the associated ring portion such that the protrusions 41 are located within the distance of the thickness of a ring portion 16, 18 in the longitudinal direction. Alternately, each protrusion 41 may be located within a distance of double the thickness of a ring portion 16, 18, or triple the thickness of a ring portion 16, 18, or four times the thickness of a ring portion 16, 18, as measured in the longitudinal direction.

As shown, for example in FIG. 1, the upper support 12 includes an upper support locking slot 50 located along a lower edge thereof and extending generally longitudinally. Similarly, the lower support portion 14 includes a locking slot 52 formed in its lower edge thereof. The locking protrusion 46 of the actuator includes a finger portion 54 having a generally "hook"-shaped end 56 (FIG. 7). The locking slot 50 of the upper support portion 12 (and optionally the locking slot 52 of the lower support portion 14) may include a slightly widened end tip opening 57 shaped to lockingly receive the hook end portion 56 of the locking protrusion 46 therein.

In particular, when the binding mechanism 10 is moved into its closed position, the locking slots 50, 52 of the upper 12 and lower 14 support portions become aligned (see FIG. 7) and the locking protrusion 46 is urged into the aligned locking slots 50, 52. As the actuator 40 is pushed inwardly, the hook tip 56 of the locking protrusion 46 may engage the angled guide surface 58 of the locking slot 50 which urges the end 56 of the locking protrusion 46 to the left. FIG. 7 illustrates the end 56 of the locking protrusion 46 moved to its left, although the degree of movement shown in FIG. 7 is exaggerated, for illustrative purposes, from the expected deflection of the end 56.

As the actuator 40 is continued to be pushed inwardly from its position shown in FIG. 7, the hook end 56 will snap into the enlarged end opening 57 of the locking slot 50 to thereby secure the actuator 40 to the upper 12 and/or lower 14 support portions, and thereby retain the binding mechanism 10 in its closed position. In other words, as the binding mechanism 10 is moved into its closed position, the locking slots 50, 52 of upper 12 and lower 14 support portions become aligned, and the locking protrusion 46 and locking slots 50, 52 cooperate to retain the binding mechanism 10 in its closed position.

When it is desired to open the binding mechanism 10, the user may grip the gripping portion 42 of the actuator 40 and pull downwardly with sufficient force to cause the locking protrusion 46 to be urged out of the aligned locking slots 50, 52. In this manner, the locking protrusion 46 and locking slots 50, 52 may together form a locking mechanism which is operable to positively lock and secure the first 12 and second 14 support portions, and the actuator 40, together when the first 12 and second 14 support portions are in the closed position. In particular, the locking protrusion 46 and locking slot 50 provides locking faces 51 which extend in a perpendicular direction to the motion of the locking protrusion 46, wherein the locking faces 51 engage each other to lock the binding mechanism 10 in place.

Various other structures, such as various interlocks, interengaging geometry, positive locking structures, overcam features, snaps, etc. may be utilized as the locking mechanism. Furthermore, the orientation of the locking protrusion 46 and locking slots 50, 52 may be reversed such that a locking protrusion is located on one or both of the support portions 12, 14, and a locking slot is located on the actuator 40.

As shown in FIG. 1, the lower support portion 14 may include a pair of travel-limiting slots 37 formed therethrough. The travel-limiting slots 37 extend in a lateral direction across the width of the lower support portion 14. The upper support portion 12 includes a set of travel-limiting protrusions 39 that are shaped and located to fit into the travel-limiting slots 37. The travel-limiting slots 37 and travel-limiting protrusions 39 are configured such that when the binding mechanism 10 is moved to its open position, each travel-limiting protrusions 39 engages the end of its associated travel-limiting slot 37 (see FIG. 4). In this manner, the travel-limiting protrusions 39 and travel-limiting slots 37 cooperate to limit the travel of the upper portion 12 relative to the lower support portion 14. Of course, the orientation of the travel-limiting protrusions 39 and travel-limiting slots can be reversed such that the travel-limiting protrusions 39 are located on the lower support portion 14 and the travel-limiting slots 37 are located on the upper support portion 12.

Thus the travel-limiting protrusions 39 and travel-limiting slots 37 limit the opening motion of the binding mechanism 10 to thereby prevent the upper portion 12 from being forcibly separated from the lower portion 14. In addition, if the upper support portion 12 were attempted to be separated from the lower support portion 14 when the binding mechanism 10 is in its open position, for example by attempting to pivot the upper support portion 12 about its longitudinal axis, such attempted rotation would merely drive the travel-limiting protrusions 39 deeper into the travel-limiting slots 37 to provide a secure gripping force between the upper 12 and lower 14 support portion.

As discussed above, the actuator protrusions 41 help to secure the upper two rings 20, 22 when the binding mechanism 10 is in the closed position. Further, the locking mechanism helps to secure the upper 12 and lower 14 support portions together at or adjacent to the lower ring 24. Thus, the locking mechanism helps to secure the ring portions 16, 18 of the lower ring 24 together so that in the closed position all three rings 20, 22, 24 are securely held in the closed position.

As best shown in FIG. 2, the indicator portion 48 of the actuator 40 extends from a short or lateral edge thereof. The indicator portion 48 is shaped and arranged such that when the binding mechanism 10 is in its closed position (see FIGS. 5 and 6), the indicator portion 48 protrudes outwardly from the body of the binding mechanism 10 (i.e., protrudes outwardly beyond the support portions 12, 14) such that the indicator portion 48 is visible. The indicator portion 48 may be made of a visually distinctive material, such as a specific color (i.e., green or red), texture, pattern or may include various text (i.e., "closed"), indicia, etc. located thereon. In the illustrated embodiment, the indicator portion 48 includes a "locked" symbol 43. The indicator portion 48 may also have a visual property that is distinct from the visual portions of any adjacent components (i.e., the support portions, the finger gripping portion 42, adjacent portions of a binder (FIG. 3), etc.).

When the binding mechanism 10 is no longer in its closed position, the actuator 40 is moved downwardly thereby retracting the indicator portion 48 within the binding mechanism 10 and hiding the indicator portion 48 from view. Various other indicators or indicator portions may be utilized. For example, rather than having an indicator which indicates when the binding mechanism 10 is in its closed position, an indicator or indicator portion may be located along the bottom edge of the actuator 40, or be otherwise mechanically actuated, to become visible when the binding mechanism 10 is in its open position. For example, an indicator portion may be located below the actuator 40 that is covered by the actuator 40 when the actuator 40 is pulled downwardly.

The indicator portion 48 may be located inside of or coupled to either of the support portions 12, 14. For example, the indicator portion may be spring biased inside of the support portions 12, 14, and may be contacted and urged outwardly to a visible location when the actuator 40 is moved to its closed position. It also may be desired to locate the indicator portion on one of the longitudinal ends of the binding mechanism 10 so that the indicator can remain visible even when papers 13 or other components are bound to the binding mechanism.

The binding mechanism 10 may also include "unlocked" indicia. For example, in the illustrated embodiment an "unlock" symbol 45 is located on the actuator 40 adjacent to the gripping portion 42. The unlock symbol 45 is located below the lower support portion 14 and is hidden therefore from view when the binding mechanism 10 is in its closed position, and is pulled out from under the lower support portion 14 and visible when the binding mechanism 10 is in its open position.

Each of the upper 12 and lower 14 support portions may include indicia, such as measuring or ruler indicia, located thereon. For example, as shown in FIG. 1, the lower support portion 14 includes English unit measuring indicia 61 located thereon, and as shown in FIG. 2 the upper support portion 12 includes metric unit measuring indicia 63 located thereon. These measuring indicia 61, 63 allow the binding mechanism 10 to serve as a quick and easily accessible ruler for quick measurements. The indicia 61, 63 may be formed thereon by a variety of methods, including printing, etching, molding and the like.

Figure 3:
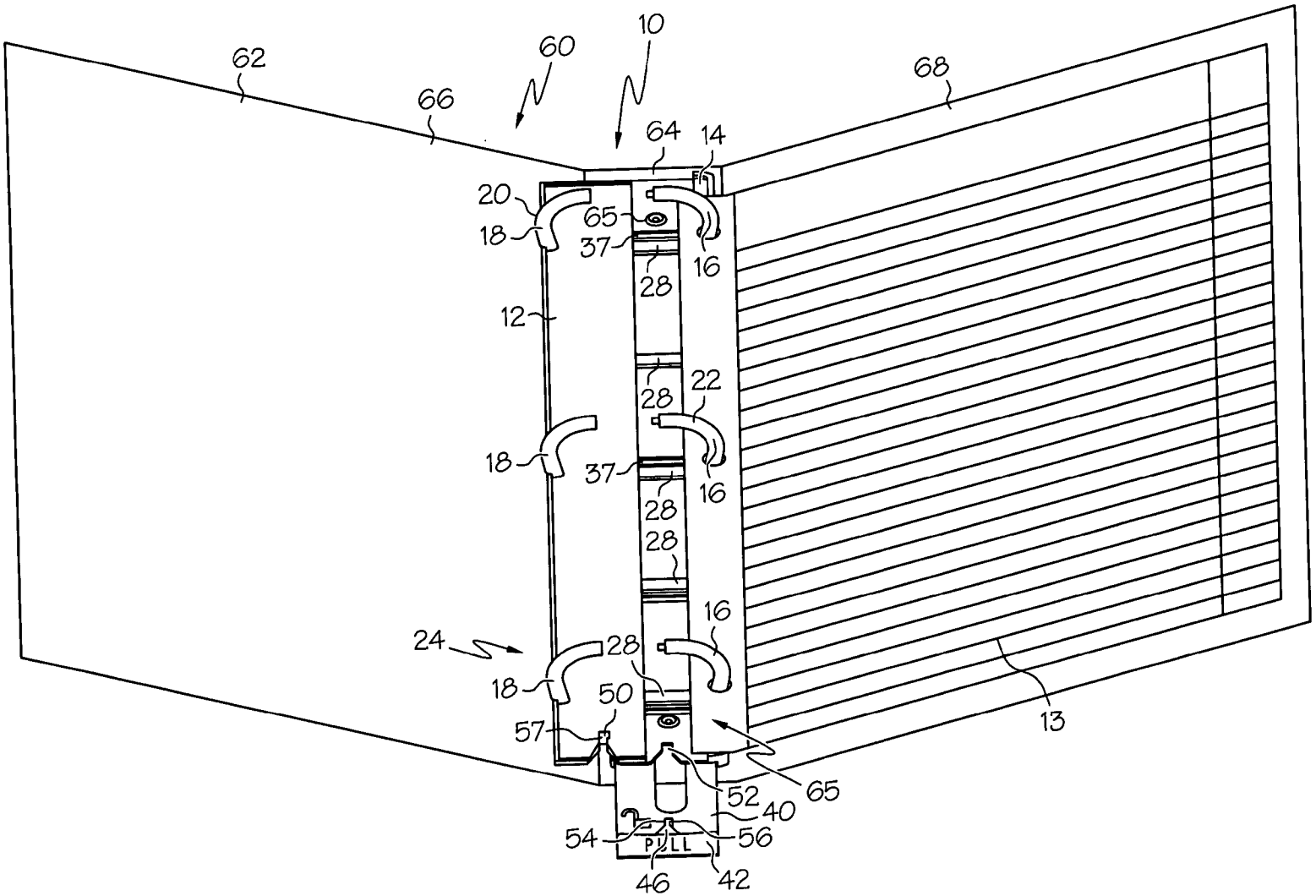
FIG. 3 is a top perspective view of the binding mechanism of FIG. 1, shown in its assembled condition and mounted to a binder cover and binding a sheet of paper.

As shown in FIG. 3, the binding mechanism 10 may be coupled to a binder 60 including a binder cover body 62 having a spine portion 64, a front cover 66 pivotally coupled to the spine portion 64 and a rear cover 68 pivotally coupled to an opposite side of the spine portion 64. Rather than being coupled to the spine 64, the binding mechanism 10 may instead be coupled to the inside of the front cover 66 or rear cover 68. In addition, the binding mechanism 10 may be mounted in an inverted orientation from that shown in FIG. 3 such that, for example, the actuator 40 is located adjacent to the top edge of the binder cover body 62. In order to attach the binding mechanism 10 to the binder cover body 62, a set of fasteners 65 (FIG. 2) may be passed through fastener openings 67 of the lower support portion 14, through the fastener slots 44 of the actuator 40, and into the binder cover body 62 (i.e., into the spine portion 64).

The fastener slots 44 of the actuator 40 allow the actuator 40 to continue to slide while receiving the fasteners 65 therethrough. Furthermore, the fastener slots 44 of the actuator 40 may cooperate with the fasteners 65 to ensure that the actuator 40 is not longitudinally moved beyond its desired limits. The fasteners 65 also completely secure the actuator 40 and lower support 14 to the binder 60 to prevent removal therefrom by the end user.

In this manner the binding mechanism 10 provides a binding mechanism that can be easily operated, is robust, and provides a smooth opening and closing operation. In addition, the binding mechanism 10 is preferably not spring loaded, but is instead position neutral and closes or opens under the power of the operator which prevents a user's fingers from being pinched between the rings. The binding mechanism can be easily operated with a single hand and can be mounted in a variety of orientations.

Having described the invention in detail and by reference to the preferred embodiments, it will be apparent that modifications and variations thereof are possible without departing from the scope of the invention.

What is claimed is:

1. A binding mechanism system comprising:

a first support portion including a first ring portion located thereon;

a second support portion including a second ring portion located thereon, at least one of said first and second support portions being movable in a translational, non-pivoting motion in a first direction relative to the other between a closed position wherein said first and second ring portions contact to form a generally closed ring, and an open position wherein said first and second ring portions are spaced apart from each other;

an indicator movable in a translational, non-pivoting motion in a second direction wherein said indicator is visible when said ring portions are in said closed position and is generally not visible when said ring portions are in said open position, wherein said first and second directions are perpendicular to one another;

an actuator which can be manually operated to move said first and second support portions between said open and closed positions, wherein and said actuator moves in said second direction in translational, non-pivoting motion; and a locking mechanism which is operable to secure said first and second support portions and said actuator together when said first and second support portions are in said closed position;

wherein said locking mechanism includes a locking protrusion located on said actuator, a first locking slot located on said first support portion, and a second locking slot located on said second support portion.

2. The binding mechanism system of claim 1 wherein said binding mechanism is generally rectangular in top view and includes a pair of long sides and a pair of short sides, and wherein said indicator protrudes outwardly from one of said short sides when said indicator is visible.

3. The binding mechanism system of claim 1 wherein at least one of said locking slots moves toward the other along said first direction as the binding mechanism is moved into a closed position and said locking slots are generally aligned and overlap when said first and second support portions are in said closed position, and wherein said locking protrusion moves toward said locking slots in said second direction and is receivable in both of said aligned locking slots to secure said first and second support portions together.

4. The binding mechanism system of claim 1 wherein said indicator is directly coupled to said actuator.

5. The binding mechanism system of claim 1 wherein said first support portion is located on and slidably supported by said second support portion.

6. The binding mechanism of claim 5 wherein said first support portion includes a first support angled guide slot or a first support protrusion formed on a bottom surface thereof, and wherein said actuator includes one actuator protrusion slidably received in said angled guide slot or an angled actuator guide slot slidably receiving said first support protrusion therein, such that movement of said actuator causes said protrusion to slide in said angled guide slot which causes relative lateral movement between said first and second support portions.

7. The binding mechanism system of claim 6 wherein said second support portion includes at least one access slot formed therethrough which receives said protrusion therethrough.

8. The binding mechanism system of claim 1, wherein said actuator is closely received in an actuator guide slot.

9. The binding mechanism system of claim 1 wherein one of said support portions has a slide channel extending in a direction of said relative sliding movement and the other one of said support portions includes a slide protrusion slidably received in said slide channel to guide said relative sliding movement, wherein said slide channel and said slide protrusion cooperate to limit the movement apart of said support portions.

10. The binding mechanism of claim 9 wherein said slide protrusion and said slide channel are generally longitudinally aligned with said first and second ring portions.

11. The binding mechanism system of claim 1 wherein at least one of said support portions includes measuring indicia formed or located thereon.

12. The binding mechanism system of claim 1 wherein said first support portion includes a plurality of first ring portions located thereon and said second support portion includes a plurality of second ring portions located thereon, said first and second support portions and first and second ring portions being configured such that each first ring portion contacts an associated second ring portion to form a generally closed ring when said first and second support portions are in said closed position, and wherein each first ring portion is spaced apart from an associated second ring portion when said first and second support portions are in said open position.

13. The binding mechanism system of claim 1 further comprising:

a binder cover body including a spine portion, a front cover pivotally coupled to said spine portion, and a rear cover pivotally coupled to said spine portion, wherein said first and second support portions and said indicator are coupled to said binder cover body.

14. The binding mechanism system of claim 13 wherein said actuator is slidably coupled to at least one of said first or second support portions.

15. The binding mechanism system of claim 14 wherein said actuator includes a fastener slot formed therethrough, and wherein the system further includes a fastener extending through said fastener slot and at least partially through one of said first and second support portions, and extending at least partially through said binder cover body to couple said first and second support portions to said binder cover body.

16. The binding mechanism of claim 1 wherein said indicator has a visual property that is distinct from a visual property of any adjacent component when said ring portions are in said closed position.

17. The binding mechanism of claim 1 wherein said first and second support portions are position neutral and are not spring biased into either said closed position or said open position.

18. A binding mechanism comprising:

a first support portion including a first ring portion located thereon;

a second support portion including a second ring portion located thereon, at least one of said first and second support portions being movable relative to the other between a closed position wherein said first and second ring portions contact to form a generally closed ring, and an open position wherein said first and second ring portions are spaced apart from each other;

an actuator which can be manually operated to move said first and second support portions between said open and closed positions; and a locking mechanism which is operable to fixedly secure said first support portion and said actuator together or said first support portion and second support portion together when said first and second support portions are in said closed position, wherein said locking mechanism comprises:

a first locking slot located on said first support portion, a second locking slot located on said second support portion, and a locking protrusion located on said actuator, wherein in said closed position, said first and second locking slots overlap and coincide, and are engaged by said locking protrusion.

19. The binding mechanism of claim 18 wherein said locking protrusion is receivable in said locking slot to secure said first support portion and said actuator together.

20. The binding mechanism of claim 18 wherein said first support portion includes one of a support guide slot or a support protrusion located thereon, and wherein said actuator includes one of an actuator protrusion slidably received in a support guide slot or an actuator guide slot slidably receiving a support protrusion therein such that movement of said actuator causes said protrusion to slide in said guide slot which causes relative lateral movement between said first and second support portions.

21. The binding mechanism of claim 20 wherein said locking mechanism is spaced apart from any of said support guide slot, said support protrusion, said actuator protrusion or said actuator guide slot.

22. The binding mechanism of claim 18 wherein said first and second support portions move in a linear and non-rotational manner between said closed and open positions.

23. The binding mechanism of claim 18 wherein said first and second support portions are position neutral and are not spring biased into either said closed position or said open position.

24. The binding mechanism of claim 18 wherein said locking mechanism positively locks said first and second support portions together.

25. The binding mechanism of claim 18 wherein said actuator is movable and wherein said locking mechanism includes a pair of locking faces at least one of which moves away from the other as the binding mechanism is opened and moves toward the other as the binding mechanism is closed, moving in a perpendicular direction to the motion of said actuator, and wherein said locking faces engage with each other or with a portion of said actuator when said locking mechanism fixedly secures said first support portion and said actuator together or said first and second support portions together.

* * * * *